US005482807A

United States Patent [19]

Aoki et al.

[11] Patent Number: 5,482,807

[45] Date of Patent: Jan. 9, 1996

[54] POSITIVELY-CHARGEABLE TONER

[75] Inventors: Mitsuo Aoki; Takahisa Kato, both of Numazu; Masanori Suzuki, Shizuoka; Tomoe Hagiwara, Fuji, all of Japan

[73] Assignee: Ricoh Company, Ltd., Tokyo, Japan

[21] Appl. No.: 246,960

[22] Filed: May 20, 1994

[30] Foreign Application Priority Data

May 21, 1993 [JP] Japan ..... 5-119821
Oct. 15, 1993 [JP] Japan ..... 5-258254

[51] Int. Cl.[6] ..... G03G 9/097
[52] U.S. Cl. ..... 430/110
[58] Field of Search ..... 430/110

[56] References Cited

U.S. PATENT DOCUMENTS

| | | | |
|---|---|---|---|
| 3,977,983 | 8/1976 | Tsuneda | 430/115 |
| 4,229,513 | 10/1980 | Merrill et al. | 430/115 |
| 4,299,898 | 11/1981 | Williams et al. | 430/110 X |
| 4,621,039 | 11/1986 | Ciccarelli et al. | 430/110 X |
| 4,840,867 | 6/1989 | Otsu et al. | 430/110 |

FOREIGN PATENT DOCUMENTS

| | | | |
|---|---|---|---|
| 188646 | 7/1993 | Japan | 430/110 |

*Primary Examiner*—Roland Martin
*Attorney, Agent, or Firm*—Cooper & Dunham

[57] ABSTRACT

A positively-chargeable toner includes a binder resin, a coloring agent, and a quaternary-ammonium-base containing copolymer with a weight-average molecular weight of 5,000 to 25,000, which included a repeat unit of formula (I), and a repeat unit of formula (II):

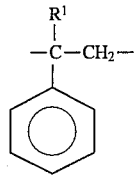

(I)

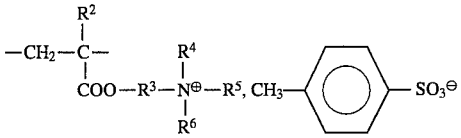

(II)

wherein $R^1$ is a hydrogen atom or a methyl group; $R^2$ is a hydrogen atom or a methyl group; $R^3$ is an alkylene group, and $R^4$, $R^5$ and $R^6$ are an alkyl group. The quaternary-ammonium-base containing copolymer may further include a repeat unit of formula (III):

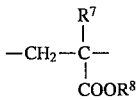

(III)

wherein $R^7$ is a hydrogen atom or a methyl group; and $R^8$ is an alkyl group.

8 Claims, No Drawings

POSITIVELY-CHARGEABLE TONER

BACKGROUND OF THE INVENTION

1. Field of the Invention

The present invention relates to a positively chargeable toner for use in electrophotography.

2. Discussion of Background

Varieties of electrophotographic methods have been disclosed, for example, in U.S. Pat. No. 2,297,691 and Japanese Patent Publications 49-23910 and 43-24748. Generally, such electrophotographic methods are capable of providing copies of images by the following steps: Electrostatic latent images are formed on a photoconductor which comprises an electrophotographic material by a variety of methods, the electrostatic latent images are developed to visible toner images with toner, and the visible toner images are transferred to a transfer sheet such as a sheet of paper and fixed thereto by the application of heat and/or pressure thereto, whereby copies of the images are obtained.

The methods of developing such electrostatic latent images can be roughly classified into a liquid development method and a dry development method.

In the liquid development method, there is employed a liquid developer in which finely-divided particles of a variety of pigments or dyes are dispersed in an insulating organic solvent.

In the dry development method, a toner comprising a natural or synthetic resin and a coloring agent, such as carbon black, which is dispersed in the resin, is employed, for example, as in the conventionally known cascade method, magnetic brush method and powder cloud method. A specific example of the dry development method is a method using a two-component dry developer.

Such a two-component dry developer comprises relatively large carrier particles and small toner particles which are held on the surface of the carrier particles by the electrostatic force generated by the friction between the carrier particles and the toner particles.

When such a two-component dry developer is brought near electrostatic latent images, the toner particles are attracted to the electrostatic latent images by the electric field formed by the electrostatic latent images and are caused to be deposited on the electrostatic latent images, with the bonding force between the toner particles and the carrier particles being overcome by the electrostatic attraction between the toner particles and the electrostatic latent images, so that the electrostatic latent images are developed to visible toner images.

Therefore, it is required that the carrier particles be capable of triboelectrically charging toner particles to the desired polarity with a sufficiently large charge quantity for developing electrostatic latent images for an extended period of time for use in practice.

However, in the case of conventional developers, a toner film is formed on the surface of carrier particles while in use by the mechanical collision between the toner particles and the carrier particles or between these particles and parts of a development unit, for example, in a copying machine, and/or by the heat generated by the above-mentioned mechanical collision.

The phenomenon that such a toner film is formed on the surface of carrier particles while in use is generally referred to as "spent phenomenon". Once such a spent phenomenon takes place in the developer, the charging characteristics of the carrier particles are significantly degraded with time while in use, so that it is required that the developer be replaced with a new developer in its entirety.

Various methods of preventing the occurrence of such a spent phenomenon have been conventionally proposed by coating the surface of carrier particles with a variety of resins.

In one of such conventional methods, a silicone resin is coated on the surface of carrier particles to prevent the occurrence of the spent phenomenon. This method, however, has the shortcoming that the silicone-resin-coated carrier particles cannot triboelectrically charge toner particles sufficiently for use in practice.

In order to triboelectrically charge toner sufficiently, there are conventionally known, for example, a method of utilizing the triboelectric charging properties of a binder resin which is employed as the main component of the toner, and a method of adding a charge-imparting agent to the toner.

Specific examples of a positive charge imparting agent which are used in practice are Nigrosine dyes as disclosed in Japanese Patent Publication 41-2427, and quaternary ammonium salts as disclosed in U.S. Pat. No. 3,565,654, and Japanese Laid-Open Patent Application 60-169857.

Furthermore, Japanese Patent Publication 59-9906 discloses a positively chargeable toner comprising a laked xanthene dye.

Conventional positive-charge imparting agents have the shortcoming that the charge quantity of the developer in which the positive-charge imparting agents are employed is largely changed depending upon the ambient conditions.

Recently it is required that the particle size of toner be significantly reduced in accordance with the demand for fine toner images with high quality. For producing such finely-divided toner particles, it is required that a charge-imparting agent be extremely uniformly dispersed in each toner particle. Conventional charge imparting agents, however, cannot meet this requirement, so that improper deposition of toner particles on the background of images, and scattering of toner particles occur when used in practice.

A quaternary ammonium salt disclosed in Japanese Laid-Open Patent Application 63-60458 is a charge imparting agent which is improved with respect to most of the above-mentioned shortcomings of the conventional charge imparting agents.

This charge imparting agent, however, cannot solve the conventional problems sufficiently when used in combination with a developer which comprises silicone resin coated carrier particles and extremely finely-divided toner particles, so that the toner deposition on the background of images and scattering of the toner particles still occur when the charge imparting agent is employed.

SUMMARY OF THE INVENTION

It is therefore an object of the present invention to provide a toner which can be positively charged sufficiently without causing the problems of the deposition thereof on the background of developed toner images and improper scattering thereof while in use even when the toner is used in combination with carrier particles which are coated with a silicone-resin for the prevention of the so-called spent phenomenon.

This object of the present invention can be achieved by a positively-chargeable toner which comprises (a) a binder resin, (b) a coloring agent, and (c) a quaternary-ammonium-base containing copolymer with a weight-average molecular weight of 5,000 to 25,000, comprising a repeat unit of formula (I) in an amount by weight of 98.0 to 99.5, and a repeat unit of formula (II) in an amount by weight of 2.0 to 0.5, when the total amount by weight of the repeat unit of formula (I) and the repeat unit of formula (II) is 100:

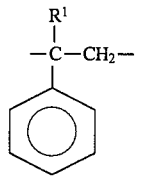

(I)

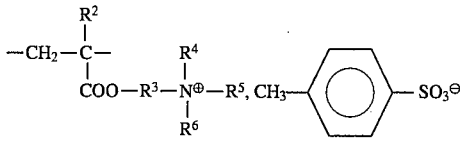

(II)

wherein $R^1$ is a hydrogen atom or a methyl group; $R^2$ is a hydrogen atom or a methyl group; $R^3$ is an alkylene group, preferably with 1 to 12 carbon atoms, and $R^4$, $R^5$ and $R^6$ are an alkyl group, preferably with 1 to 12 carbon atoms.

The above object of the present invention can also be achieved by a positively-chargeable toner which comprises (a) a binder resin, (b) a coloring agent, and (c) a quaternary-ammonium-base containing copolymer with a weight-average molecular weight of 5,000 to 25,000, comprising a repeat unit of formula (I) in an amount by weight of 98.5 to 63.0, a repeat unit of formula (II) in an amount by weight of 2.0 to 0.5, and a repeat unit of formula (III) in an amount by weight of 35.0 to 1.0 when the total amount by weight of the repeat unit of formula (I), the repeat unit of formula (II), and the repeat unit of formula (III) is 100:

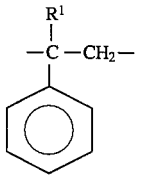

(I)

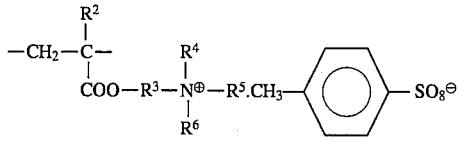

(II)

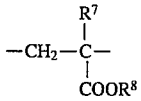

(III)

wherein $R^1$, $R^2$ and $R^7$ are independently a hydrogen atom or a methyl group; $R^3$ is an alkylene group, preferably with 1 to 12 carbon atoms, and $R^4$, $R^5$, $R^6$ and $R^8$ are an alkyl group, which may be the same or different, preferably with 1 to 12 carbon atoms.

For the object of the present invention, any of the above-mentioned toners in which as the binder agent, a binder resin which contains 50 wt. % or more of polyester resin is used, with the softening point of the toner being 85° C. or less, may be employed.

DESCRIPTION OF THE PREFERRED EMBODIMENTS

As the binder resin for use in the toner of the present invention, for example, the following conventionally known binder resins can be employed:

Styrene resins, that is, homopolymers and copolymers of styrene or substituted styrene derivatives, such as polystyrene, poly-α-methylstyrene, styrene-chloro-styrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer (for example, styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylic ester copolymer (for example, styrene-methyl methacrylate copolymer, styrene-ethyl methacrylate copolymer, styrene-butyl methacrylate copolymer, styrene-phenyl methacrylate copolymer), styrene-methyl α-methyl chloroacrylate copolymer, styrene-acrylonitrile-acrylic ester copolymer; vinyl chloride resin; rosin-modified maleic acid resin, phenol resin; epoxy resin; polyester resin; low-molecular-weight polypropylene; ionomer resin; polyurethane resin; ketone resin; ethylene-ethyl acrylate copolymer; xylene resin; and polyvinyl butylate resin. These resins can be used alone or in combination.

There is no particular limitation on the method of producing these resins, and any polymerization methods such as bulk poylmerization, solution polymerization, emulsion polymerization, and suspension polymerization can be employed.

As mentioned previously, according to the present invention, a binder resin which contains 50 wt. % or more of polyester resin may be used.

As the polyester resin used for the above-mentioned binder resin, it is preferable to use a polyester resin having a glass transition point Tg in the range of 65° to 75° C. When the content of the polyester resin is 50 wt. % or more, a toner with a softening point of 85° C. or less having low temperature image fixing performance and excellent preservability can be obtained.

Examples of the coloring agent for use in the toner of the present invention are carbon black, lamp black, iron black, aniline blue, Phthalocyanine blue, Ultramarine Blue, phthalocyanine Green, Malachite Green Oxalate, chrome yellow, Quinoline Yellow, Benzidine Yellow, Quinacridone, Rose Bengal, and triarylmethane dye. Any conventional dyes and pigments can be used alone or in combination. It is preferable that the amount of such a coloring agent be in the range of 1 to 30 parts by weight, more preferably in the range of 3 to 20 parts by weight, to 100 parts by weight of the binder resin.

The toner according to the present invention may further comprise a fluidity-improving agent such as finely-divided inorganic particles. Specific examples of the finely-divided inorganic particles are particles of silica, alumina, titanium oxide, barium titanate, magnesium titanate, calcium titanate, strontium titanate, zinc oxide, magnesium oxide, zirconium oxide, calcium carbonate, silicon carbide, and silicon nitride. These inorganic particles can be used alone or in combination. It is preferable that the amount of these fluidity-improving agents be in the range of 0.1 to 2.0 parts by weight, more preferably in the range of 0.2 to 1.5 parts by weight, to 100 parts by weight of the toner.

The toner of the present invention may further comprises a releasing agent such as a wax component when necessary. Specific examples of such a wax component include polyolefin waxes such as polyethylene wax and polypropylene wax, and natural waxes such as carnauba wax, candelilla wax, and rice wax.

A first type quaternary-ammonium-base containing copolymer for use in the toner of the present invention has a weight-average molecular weight of 5,000 to 25,000, and comprises a repeat unit of formula (I) in an amount by weight of 98.0 to 99.5, and repeat unit of formula (II) in an amount by weight of 2.0 to 0.5, when the total amount by weight of the repeat unit of formula (I) and the repeat unit of formula (II) is 100 (hereinafter, the amount ratio of the repeat unit of formula (I) is referred to as 98.0 to 99.5 wt. %, and the amount ratio of the repeat unit of formula (II) is referred to as 2.0 to 0,5 wt. %):

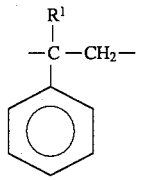

(I)

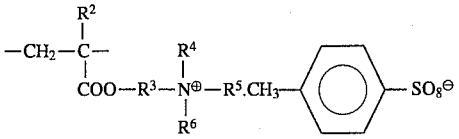

(II)

wherein $R^1$ is a hydrogen atom or an methyl group; $R^2$ is a hydrogen atom or a methyl group; $R^3$ is an alkylene group, preferably with 1 to 12 carbon atoms, and $R^4$, $R^5$ and $R^6$ are an alkyl group, preferably with 1 to 12 carbon atoms.

In the above-mentioned first type quaternary-ammonium-bass containing copolymer for use in the toner of the present invention, the amount ratio of the repeat unit of formula (I) to the repeat unit of formula (II) is important.

This first type quaternary-ammonium-base containing copolymer is superior in the dispersibility in binder resins to conventional charge-imparting agents. However, the charge-imparting effect of the first type quaternary-ammonium-base containing copolymer is so extremely strong that when the amount ratio of the repeat unit of formula (II) exceeds 2.0 wt. %, the amount of the quaternary-ammonium base containing copolymer to be added to the toner must be decreased to an extremely small amount in order to maintain the charge quantity of the toner appropriately. As a result, when high dispersibility is required as in the case of an extremely-small-particle size toner, the amount of the quaternary-ammonium base containing copolymer is insufficient, so that the deposition of the toner particles on the background of toner images and the scattering of the toner particles are apt to occur. For these reasons, it is important that the amount ratio of the repeat unit of formula (II) is set in the range of 0.5 wt. % as stated above, whereby the objects of the present invention can be achieved. In other words, when the above-mentioned first type quaternary-ammonium base containing copolymer is employed, the charge imparting effect is appropriately controlled, so that the amount of the quaternary-ammonium base containing copolymer in the toner is appropriate, whereby toner with excellent charging characteristics can be obtained.

When the amount of the repeat unit of formula (II) is less than 0.5 wt. %, a large amount of the quaternary-ammonium base containing copolymer must be added to the toner. The addition of a large amount of the quaternary-ammonium base containing copolymer has adverse effects on the thermal characteristics of the binder resin contained in the toner.

As mentioned previously, it is required that the first type quaternary-ammonium-base containing copolymer for use in the toner of the present invention have a weight-average molecular weight of 5,000 to 25,000.

When the weight-average molecular weight is less than 5,000, the mechanical strength of the quaternary-ammonium-base containing copolymer is reduced, and accordingly, the mechanical strength of the toner is also reduced. As a result, it occurs that the toner particles are destroyed while in use within a copying machine. The thus destroyed toner particles are apt to adhere to the surface of carrier particles, so that the so-called spent phenomenon takes place and therefore the life of the developer is significantly shortened.

When the weight-average molecular weight exceeds 25,000, the compatibility of the quaternary-ammonium-base containing copolymer with the binder resin for the toner is reduced, so that the dispersion of the quaternary-ammonium-base containing copolymer in the binder resin becomes improper. This causes the deposition of toner particles on the background of toner images and the scattering of the toner particles.

A second type quaternary-ammonium-base containing copolymer for use in the toner of the present invention has a weight-average molecular weight of 5,000 to 25,000, and comprises a repeat unit of formula (I) in an amount by weight of 98.5 to 63.0, a repeat unit of formula (II) in an amount by weight of 2.0 to 0.5, and a repeat unit of formula (III) in an amount by weight of 35.0 to 1.0, when the total amount by weight of the repeat unit of formula (I), the repeat unit of formula (II) and the repeat unit of formula (III) is 100 (hereinafter, the amount ratio of the repeat unit of formula (I) is referred to as 98.5 to 63.0 wt. %, the amount ratio of the repeat unit of formula (II) is referred to as 2.0 to 0.5 wt. %, and the amount ratio of the repeat unit of formula (III) is referred to as 35.0 to 1.0 wt. %):

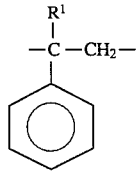

(I)

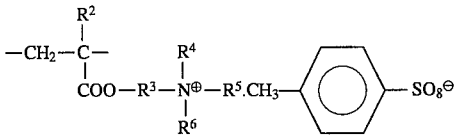

(II)

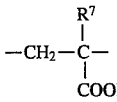

(III)

wherein $R^1$, $R^2$ and $R^7$ are independently a hydrogen atom or a methyl group; $R^3$ is an alkylene group, preferably with 1 to 12 carbon atoms, and $R^4$, $R^5$, $R^6$ and $R^8$ are an alkyl group, which may be the same or different, preferably with 1 to 12 carbon atoms.

In the above-mentioned second type quaternary-ammonium-base containing copolymer for use in the toner of the present invention, the amount ratio of the repeat unit of formula (I) to the repeat unit of formula (II) is important.

This second type quaternary-ammonium-base containing copolymer is superior in the dispersibility in binder resins to conventional charge-imparting agents. However, the charge-imparting effect of the second type quaternary-ammonium-base containing copolymer is so extremely strong that when the amount ratio of the repeat unit of formula (II) exceeds 2.0 wt. %, the amount of the quaternary-ammonium base containing copolymer to be added to the toner must be decreased to a small amount in order to maintain the charge quantity of the toner appropriately. As a result, when high dispersibility is required as in the case of an extremely-small-particle size toner, the amount of the quaternary-ammonium base containing copolymer is insufficient, so that the deposition of toner particles on the background of toner images and the scattering of the toner particles are apt to occur. For these reasons, it is important that the amount ratio of the repeat unit of formula (II) is set in the range of 0.5 to 2.0 wt. % as stated above, whereby the objects of the present invention can be achieved. In other words, when the above-mentioned second type quaternary-ammonium base containing copolymer is employed, a toner with excellent charging characteristics can be obtained.

When the amount of the repeat unit of formula (II) is less than 0.5 wt. %, a large amount of the quaternary-ammonium base containing copolymer must be added to the toner. The addition of a large amount of the quaternary-ammonium base containing copolymer has adverse effects on the thermal characteristics of the binder resin contained in the toner.

The repeat unit of formula (III) contained in the quaternary ammonium base containing copolymer has the functions of appropriately decreasing the melting viscosity of the quaternary-ammonium-base containing copolymer, and significantly improving the dispersion of the quaternary-ammonium-base containing copolymer in the binder resin.

As mentioned previously, it is required that the second type quaternary-ammonium-base containing copolymer for use in the toner of the present invention have a weight-average molecular weight of 5,000 to 25,000.

When the weight-average molecular weight is less than 5,000, the mechanical strength of the quaternary-ammonium-base containing copolymer is reduced, and accordingly, the mechanical strength of the toner is also reduced. As a result, it occurs that the toner particles are destroyed while in use within a copying machine. The thus destroyed toner particles are apt to adhere to the surface of carrier particles, so that the so-called spent phenomenon takes place and therefore the life of the developer is significantly shortened.

When the weight-average molecular weight exceeds 25,000, the compatibility of the quaternary-ammonium-base containing copolymer with the binder resin for the toner is reduced, so that dispersion of the quaternary-ammonium-base containing copolymer in the binder resin becomes improper. This causes the deposition of toner particles on the background of toner images and the scattering of the toner particles.

As the carrier for use with the toner of the present invention, it is preferable to use a carrier with the surface thereof being coated with silicone resin. Silicone resin has a very small surface energy so that it has a significant effect of preventing the spent phenomenon, but its toner charging performance is extremely low.

A developer comprising the toner of the present invention which contains the quaternary-ammonium-base containing copolymer exhibits excellent charging performance and therefore a two-component developer, which is free from the problems of toner deposition on the background of images, the scattering of toner, and the spent phenomenon, and has a long life, can be provided when the toner of the present invention is employed.

It is preferable that the amount of the quaternary-ammonium-base containing copolymer be in the range of 0.2 to 5.0 parts by weight, to 100 parts by weight of the toner.

The toner of the present invention can be prepared by kneading and fusing (a) a binder resin, (b) a coloring agent, (c) a first type or second type quaternary-ammonium-base containing copolymer with a weight-average molecular weight of 5,000 to 25,000, and other components such wax when necessary, in a kneader such as an extruder, cooling the kneaded mixture thereof to solidify the same, pulverizing the solidified mixture, and classifying the pulverized mixture to obtain finely-divided particles with a volume mean diameter in the range of 5 to 10 μm which are used as the toner of the present invention.

As mentioned previously, as the carrier for use with the toner of the present invention, a silicone-resin-coated carrier is most useful. As the silicone resin for the carrier, any conventional silicone resins can be employed. For example, an ordinary temperature curing type silicone resin of the following formula (IV) can be employed:

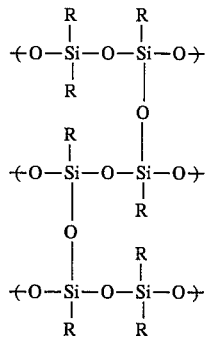

(IV)

wherein R is a hydrogen atom, a halogen atom, a hydroxyl group, a methoxy group, an alkyl group having 1 to 4 carbon atoms, or a phenyl group.

As the core material for the carrier particles, conventionally employed metals, alloys and non-metal materials, such as cobalt, iron, copper, nickel, zinc, aluminum, brass, and glass, can be employed.

The silicone resin can be coated on such a core material by a conventional coating method such as spray coating which is conducted by dissolving the silicone resin in a solvent and spraying the solution on the surface of the core material.

It is preferable that the carrier and the toner of the present invention be mixed in such a ration that the toner particles covers 30 to 90% of the entire surface of each carrier particle.

Other features of this invention will become apparent in the course of the following description of exemplary embodiments, which are given for illustration of the invention and are not intended to be limiting thereof.

EXAMPLE 1

[Preparation of Toner No. 1]

The following components were kneaded and pulverized in an extruder, and the pulverized mixture was classified, whereby toner particles with a volume mean diameter of 11 μm were obtained:

| | Parts by Weight |
|---|---|
| Styrene resin (Trademark "D-125" made by Esso Sekiyu K.K.) | 88 |
| Carbon black (Trademark "#44" made by Mitsubishi | 10 |

-continued

| | Parts by Weight |
|---|---|
| Chemical Industries, LTD.) | |
| First type quaternary-ammonium-base containing copolymer (Mw. 10,000) [the ratio of the repeat unit of formula (I-1):the repeat unit of formula (II-1) is 99:1] | 2 |

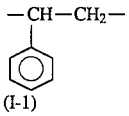

(I-1)

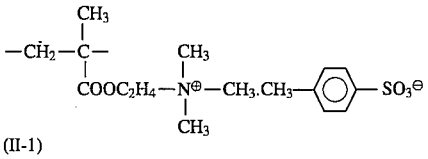

(II-1)

The thus obtained toner particles are referred to as Toner No. 1 of the present invention.

[Preparation of Carrier]

| | | Parts by Weight |
|---|---|---|
| Core material: | Spherical particles of iron oxide with an average particle diameter of 100 μm | 100 |
| Coating liquid: | 5% toluene solution of styrene - methyl-methacrylate copolymer | 20 |

A mixture of the above components with the above formulation was mixed in a fluidized bed coating apparatus, whereby the surface of the iron oxide particles was coated with the above coating liquid, and the coated liquid was dried and solidified, whereby a carrier for use in the present invention was obtained.

Developer No. 1 was prepared by mixing the above prepared Toner No. 1 and carrier with the concentration of the toner in the developer being 3 wt.%.

The charge quantity of this developer using this toner was 28 μC/g.

The developer was subjected to evaluation tests by use of a commercially available copying machine (Trademark "Ricopy FT 3300" made by Ricoh Company, Ltd.) by making 100,000 copies to evaluate the toner deposition on the background of developed images, the scattering of the toner from a development unit of the copying machine, and the occurrence of the spent phenomenon by the following respective evaluation methods:

(1) Evaluation of Toner Deposition on the Background of Images

A blank white original is copied, and the reflection density of the copy is measured by Macbeth densitometer. The evaluation value when there is no toner deposition on the copy paper is 0.12, and the larger the value, the greater the toner deposition on the copy paper and therefore the more the smearing of the copy paper with the toner.

(2) Evaluation of Toner Scattering

A white square paper sheet with a size of 4 cm×4 cm is applied to the inside of a front cover of the copying machine, and the toner deposited thereon by the scattering thereof is measured by the Macbeth densitometer. The evaluation value when there is no scattering of the toner and therefore no toner deposition on the paper is 0.12, and the larger the value, the greater the extent of the toner scattering.

(3) Evaluation of Spent Phenomenon

A sample developer is subjected to a blow-off treatment to remove the toner therefrom, and the weight of the developer is measured $W_1$. To this developer, toluene is added, so that the toner deposited or adhering to the surface of the carrier particles is completely dissolved in the toluene and removed therefrom. The resulting developer is dried, and the weight of the developer is measured $W_2$.

The spent toner amount for evaluation of the spent phenomenon is determined in accordance with the following formula:

$$\text{Spent toner amount } W(\%)=(W_1-W_2)/W_1\times 100$$

The results of the above evaluation tests are shown in Table 1.

Comparative Example 1

[Preparation of Comparative Toner No. 1]

The following components were kneaded and pulverized in an extruder, and the pulverized mixture was classified, whereby toner particles with a volume mean diameter of 11 μm were obtained:

| | Parts by Weight |
|---|---|
| Styrene resin (Trademark "D-125" made by Esso Sekiyu K.K.) | 89.5 |
| Carbon black (Trademark "#44" made by Mitsubishi Chemical Industries, LTD.) | 10 |
| First type quaternary-ammonium-base containing copolymer (Mw. 10,000) [the ratio of the repeat unit of formula (I-1):the repeat unit of formula (II-1) is 95:5] | 0.5 |

The thus obtained toner particles are referred to as Comparative Toner No. 1.

Comparative Developer No. 1 was prepared by mixing the above prepared Comparative Toner No. 1 and the carrier prepared in Example 1 with the concentration of the toner in the developer being 3 wt.%.

The charge quantity of this developer was using this toner 27 μC/g, which was not so much different from the charge quantity of the developer prepared in Example 1.

The above comparative developer was subjected to the same evaluation tests as in Example 1. The results are shown in Table 1.

TABLE 1

| | Test Items | Number of Copies Made | | | | | |
|---|---|---|---|---|---|---|---|
| | | 0 | 20000 | 40000 | 60000 | 80000 | 100000 |
| Ex. 1 | Toner Deposition | 0.12 | 0.12 | 0.12 | 0.12 | 0.13 | 0.13 |
| | Toner Scattering | 0.12 | 0.12 | 0.12 | 0.13 | 0.13 | 0.14 |
| | Spent Amount | 0 | 0.01 | 0.02 | 0.02 | 0.03 | 0.05 |
| Comp. Ex. 1 | Toner Deposition | 0.13 | 0.13 | 0.14 | 0.14 | 0.16 | 0.19 |
| | Toner Scattering | 0.12 | 0.14 | 0.17 | 0.20 | 0.13 | 0.46 |
| | Spent Amount | 0 | 0.02 | 0.02 | 0.03 | 0.04 | 0.06 |

The results shown in the above Table 1 indicate that Developer No. 1 comprising Toner No. 1 prepared in Example 1 is superior to Comparative Developer No. 1 prepared in Comparative Example 1.

EXAMPLE 2

The procedure of preparing Toner No. 1 in Example 1 was repeated except that the volume mean diameter of the toner particles prepared in Example 1 was decreased to 8.5 μm, whereby Toner No. 2 of the present invention was prepared.

The procedure of preparing Developer No. 1 in Example 1 was repeated except that Toner No. 1 employed in Example 1 was replaced by the above prepared Toner No. 2, whereby Developer No. 2 was prepared.

The thus prepared Developer No. 2 was subjected to the same evaluation tests as in Example 1. The results are shown in Table 2.

Comparative Example 2

The procedure of preparing Comparative Toner No. 1 in Comparative Example 1 was repeated except that the volume mean diameter of the toner particles prepared in Comparative Example 1 was decreased to 8.5 μm, whereby Comparative Toner No. 2 was prepared.

The procedure of preparing Comparative Developer No. 1 in Comparative Example 1 was repeated except that Comparative Toner No. 1 employed in Comparative Example 1 was replaced by the above prepared Comparative Toner No. 2, whereby Comparative Developer No. 2 was prepared.

The thus prepared Comparative Developer No. 2 was subjected to the same evaluation tests as in Example 1. The results are shown in Table 2.

TABLE 2

| | Test Items | Number of Copies Made | | | | | |
|---|---|---|---|---|---|---|---|
| | | 0 | 20000 | 40000 | 60000 | 80000 | 100000 |
| Ex. 2 | Toner Deposition | 0.12 | 0.12 | 0.12 | 0.12 | 0.13 | 0.13 |
| | Toner Scattering | 0.12 | 0.12 | 0.12 | 0.13 | 0.14 | 0.15 |
| | Spent Amount | 0 | 0.01 | 0.02 | 0.03 | 0.04 | 0.06 |
| Comp. Ex. 2 | Toner Deposition | 0.13 | 0.13 | 0.14 | 0.16 | 0.19 | 0.21 |
| | Toner Scattering | 0.12 | 0.16 | 0.20 | 0.36 | 0.44 | 0.69 |
| | Spent Amount | 0 | 0.03 | 0.05 | 0.09 | 0.12 | 0.21 |

The results shown in the above Table 2 indicate that Developer No. 2 comprising Toner No. 2 prepared in Example 2 is superior to Comparative Developer No. 2 prepared in Comparative Example 2.

EXAMPLE 3

[Preparation of Toner No. 3]

The following components were kneaded and pulverized in an extruder, and the pulverized mixture was classified, whereby toner particles with a volume mean diameter of 6.5 μm were obtained:

| | Parts by Weight |
|---|---|
| Styrene resin (Trademark "D-125" made by Esso Sekiyu K.K.) | 86 |
| Carbon black (Trademark "#44" made by Mitsubishi Chemical Industries, LTD.) | 10 |
| First type quaternary-ammonium-base containing copolymer (Mw. 20,000) [the ratio of the repeat unit of formula (I-1):the repeat unit of formula (II-2) is 98.5:1.5] | 4 |

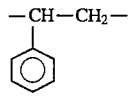

(I-1)

-continued

| | Parts by Weight |
|---|---|
| 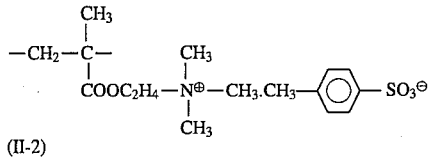 (II-2) | |

The thus obtained toner particles are referred to as Toner No. 3 of the present invention.

[Preparation of Carrier]

| | | Parts by Weight |
|---|---|---|
| Core material: | Spherical particles of ferrite with an average particle diameter of 100 μm | 100 |
| Coating liquid: | Silicone resin solution (Trademark "SR2411" made by Dow Corning Toray Silicone Co., Ltd.) | 20 |

A mixture of the above components with the above formulation was mixed in a fluidized bed coating apparatus, whereby the surface of the ferrite particles was coated with the above coating liquid, and the coated liquid was dried and solidified, whereby a carrier for use in the present invention was obtained.

Developer No. 3 was prepared by mixing the above prepared Toner No. 3 and carrier with the concentration of the toner in the developer being 3 wt. %.

The charge quantity of this developer using the toner was 22 μC/g.

The above prepared Developer No. 3 was subjected to the same evaluation tests as in Example 1. The results are shown in Table 3.

Comparative Example 3

[Preparation of Comparative Toner No. 3]

The following components were kneaded and pulverized in an extruder, and the pulverized mixture was classified, whereby toner particles with a volume mean diameter of 6.5 μm were obtained:

| | Parts by weight |
|---|---|
| Styrene resin (Trademark "D-125" made by Esso Sekiyu K.K.) | 89.5 |
| Carbon black (Trademark "#44" made by Mitsubishi Chemical Industries, LTD.) | 10 |
| First type quaternary-ammonium-base containing copolymer (Mw. 20,000) [the ratio of the repeat unit of formula (I-1):the repeat unit of formula (II-2) is 90:10] | 0.5 |

The thus obtained toner particles are referred to as Comparative Toner No. 3.

Comparative Developer No. 3 was prepared by mixing the above prepared Comparative Toner No. 3 and the carrier prepared in Example 3 with the concentration of the toner in the developer being 3 wt. %.

The charge quantity of this comparative developer was 24 μC/g, which was not so much different from the charge quantity of Developer No. 3 prepared in Example 3.

The above Comparative Developer No. 3 was subjected to the same evaluation tests as in Example 1. The results are shown in Table 3.

TABLE 3

| | Test Items | Number of Copies Made | | | | | |
|---|---|---|---|---|---|---|---|
| | | 0 | 20000 | 40000 | 60000 | 80000 | 100000 |
| Ex. 1 | Toner Deposition | 0.12 | 0.12 | 0.12 | 0.12 | 0.12 | 0.12 |
| | Toner Scattering | 0.12 | 0.12 | 0.12 | 0.13 | 0.12 | 0.12 |
| | Spent Amount | 0 | 0 | 0.01 | 0.01 | 0.02 | 0.02 |
| Comp. Ex. 1 | Toner Deposition | 0.12 | 0.13 | 0.14 | 0.15 | 0.16 | 0.18 |
| | Toner Scattering | 0.12 | 0.15 | 0.27 | 0.32 | 0.40 | 0.55 |
| | Spent Amount | 0 | 0.02 | 0.04 | 0.07 | 0.10 | 0.11 |

The results shown in the above Table 3 indicate that Developer No. 3 comprising Toner No. 3 prepared in Example 2 is superior to Comparative Developer No. 3 prepared in Comparative Example 3.

EXAMPLE 4

[Preparation of Toner No. 4]

The following components were kneaded and pulverized in an extruder, and the pulverized mixture was classified, whereby toner particles with a volume mean diameter of 11 μm were obtained:

| | Parts by Weight |
|---|---|
| Styrene resin (Trademark "D-125" made by Esso Sekiyu K.K.) | 88 |
| Carbon black (Trademark "#44" made by Mitsubishi | 10 |

-continued

| | Parts by Weight |
|---|---|
| Chemical Industries, LTD.) Second type quaternary-ammonium-base containing copolymer (Mw. 10,000) [the ratio of the repeat unit of formula (I-1):the repeat unit of formula (II-1):the repeat unit of formula (III-1) is 90:1:9] | 2 |

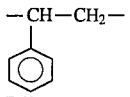

(I-1)

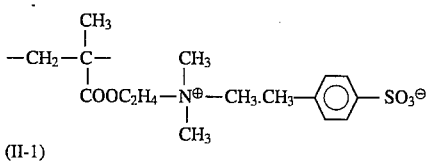

(II-1)

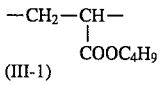

(III-1)

The thus obtained toner particles are referred to as Toner No. 4 of the present invention.

[Preparation of Carrier]

| | | Parts by Weight |
|---|---|---|
| Core material: | Spherical particles of iron oxide with an average particle diameter of 100 μm | 100 |
| Coating liquid: | 5% toluene solution of styrene - methyl-methacrylate copolymer | 20 |

A mixture of the above components with the above formulation was mixed in a fluidized bed coating apparatus, whereby the surface of the iron oxide particles was coated with the above coating liquid, and the coated liquid was dried and solidified, whereby a carrier for use in the present invention was obtained.

Developer No. 4 was prepared by mixing the above prepared Toner No. 4 and carrier with the concentration of the toner in the developer being 3 wt. %.

The charge quantity of this developer was 25 μC/g.

The above prepared Developer No. 4 was subjected to the same evaluation tests as in Example 1. The results are shown in Table 4.

Comparative Example 4

[Preparation of Comparative Toner No. 4]

The following components were kneaded and pulverized in an extruder, and the pulverized mixture was classified, whereby toner particles with a volume mean diameter of 11 μm were obtained:

| | Parts by weight |
|---|---|
| Styrene resin (Trademark "D-125", made by Esso Sekiyu K.K.) | 89.5 |
| Carbon black (Trademark "#44" made by Mitsubishi Chemical Industries, LTD.) | 10 |
| Second type quaternary-ammonium-base containing copolymer (Mw. 10,000) [the ratio of the repeat unit of formula (I-1):the repeat unit of formula (II-1):the repeat unit of formula (III-1) is 55:5:40] | 0.5 |

The thus obtained toner particles are referred to as Comparative Toner No. 4.

Comparative Developer No. 4 was prepared by mixing the above prepared Comparative Toner No. 4 and the carrier prepared in Example 4 with the concentration of the toner in the developer being 3 wt. %.

The charge quantity of this developer was 24 μC/g, which was not so much different from the charge quantity of Developer No. 4 prepared in Example 4.

The above Comparative Developer No. 4 was subjected to the same evaluation tests as in Example 1. The results are shown in Table 4.

TABLE 4

| | | Number of Copies Made | | | | | |
|---|---|---|---|---|---|---|---|
| | Test Items | 0 | 20000 | 40000 | 60000 | 80000 | 100000 |
| Ex. 4 | Toner Deposition | 0.12 | 0.12 | 0.12 | 0.12 | 0.13 | 0.13 |
| | Toner Scattering | 0.12 | 0.12 | 0.12 | 0.1222 | 0.13 | 0.13 |
| | Spent Amount | 0 | 0.01 | 0.01 | 0.02 | 0.03 | 0.04 |
| Comp. Ex. 4 | Toner Deposition | 0.13 | 0.13 | 0.13 | 0.14 | 0.15 | 0.18 |
| | Toner Scattering | 0.12 | 0.14 | 0.15 | 0.19 | 0.28 | 0.44 |
| | Spent Amount | 0 | 0.02 | 0.02 | 0.03 | 0.04 | 0.05 |

The results shown in the above Table 4 indicate that Developer No. 4 comprising Toner No. 4 prepared in Example 4 is superior to Comparative Developer No. 4 prepared in Comparative Example 4.

EXAMPLE 5

[Preparation of Toner No. 5]

The following components were kneaded and pulverized in an extruder, and the pulverized mixture was classified, whereby toner particles with a volume mean diameter of 12 μm were obtained:

| | Parts by Weight |
|---|---|
| Styrene resin prepared by copolymerizing styrene and the repeat unit of formula (III-1) in Example 4 which | 88 |

-continued

| | Parts by Weight |
|---|---|
| is in an amount of 20 wt. % | |
| Carbon black (Trademark "#44", made by Mitsubishi Chemical Industries, LTD.) | 10 |
| Second type quaternary-ammonium-base containing copolymer (Mw. 10,000) [the ratio of the repeat unit of formula (I-1):the repeat unit of formula (II-1):the repeat unit of formula (III-1) is 90:1:9] which is the same quaternary-ammonium-base containing copolymer as that used in Example 4 | 2 |

The thus obtained toner particles are referred to as Toner No. 5 of the present invention.

Developer No. 5 was prepared by mixing the above prepared Toner No. 5 and the same carrier as prepared in Example 4 with the concentration of the toner in the developer being 3 wt. %.

The charge quantity of this developer was 29 μC/g.

The above prepared Developer No. 5 was subjected to the same evaluation tests as in Example 1. The results are shown in Table 5.

EXAMPLE 6

The procedure for preparing Toner No. 5 in Example 5 was repeated except that the binder resin employed in Example 5 was replaced by a styrene resin which was the same styrene resin as that employed in Example 5 except that the repeat unit of formula (III-1) was eliminated therefrom, that is, styrene homopolymer, whereby Toner No. 6 was prepared.

The procedure for preparing Developer No. 5 in Example 5 was also repeated except that Toner No. 5 employed in Example 5 was replaced by the above prepared Toner No. 6, whereby Developer No. 6 was prepared.

The charge quantity of this developer was 27 μC/g, which was not so much different from the charge quantity of Developer No. 5 prepared in Example 5.

The above prepared Developer No. 6 was subjected to the same evaluation tests as in Example 1. The results are shown in Table 6.

TABLE 5

| | Test Items | Number of Copies Made | | | | | |
|---|---|---|---|---|---|---|---|
| | | 0 | 20000 | 40000 | 60000 | 80000 | 100000 |
| Ex. 1 | Toner Deposition | 0.12 | 0.12 | 0.12 | 0.12 | 0.12 | 0.13 |
| | Toner Scattering | 0.12 | 0.12 | 0.12 | 0.12 | 0.12 | 0.13 |
| | Spent Amount | 0 | 0 | 0.01 | 0.01 | 0.01 | 0.02 |
| Ex. 6 | Toner Deposition | 0.12 | 0.12 | 0.12 | 0.13 | 0.13 | 0.17 |
| | Toner Scattering | 0.12 | 0.12 | 0.12 | 0.12 | 0.13 | 0.13 |
| | Spent Amount | 0 | 0.01 | 0.01 | 0.02 | 0.02 | 0.03 |

The results shown in the above Table 5 indicate that Developer No. 5 comprising Toner No. 5 prepared in Example 5 is superior in the anti-spent performance to Developer No. 6 prepared in Example 6.

EXAMPLE 7

The procedure of preparing Toner No. 5 in Example 5 was repeated except that the volume mean diameter of the toner particles prepared in Example 1 was decreased to 8.5 μm, whereby Toner No. 7 of the present invention was prepared.

The procedure of preparing Developer No. 5 in Example 5 was repeated except that Toner No. 5 employed in Example 5 was replaced by the above prepared Toner No. 7, whereby Developer No. 7 was prepared.

The thus prepared Developer No. 7 was subjected to the same evaluation tests as in Example 1. The results are shown in Table 6.

EXAMPLE 8

The procedure of preparing Toner No. 6 in Example 6 was repeated except that the volume mean diameter of the toner particles prepared in Example 6 was decreased to 8.5 μm, whereby Toner No. 8 was prepared.

The procedure of preparing Developer No. 6 in Example 6 was repeated except that Toner No. 6 employed in Example 6 was replaced by the above prepared Toner No. 8, whereby Developer No. 8 was prepared.

The thus prepared Developer No. 8 was subjected to the same evaluation tests as in Example 1. The results are shown in Table 6.

TABLE 6

| | Test Items | Number of Copies Made | | | | | |
|---|---|---|---|---|---|---|---|
| | | 0 | 20000 | 40000 | 60000 | 80000 | 100000 |
| Ex. 7 | Toner Deposition | 0.12 | 0.12 | 0.12 | 0.12 | 0.13 | 0.13 |
| | Toner Scattering | 0.12 | 0.12 | 0.12 | 0.13 | 0.13 | 0.15 |
| | Spent Amount | 0 | 0 | 0.01 | 0.02 | 0.03 | 0.05 |
| Ex. 8 | Toner Deposition | 0.12 | 0.12 | 0.13 | 0.13 | 0.13 | 0.14 |
| | Toner Scattering | 0.12 | 0.12 | 0.13 | 0.14 | 0.15 | 0.16 |
| | Spent Amount | 0 | 0.01 | 0.01 | 0.02 | 0.03 | 0.05 |

The results shown in the above Table 6 indicate that Developer No. 7 comprising Toner No. 7 prepared in Example 7 is superior in the anti-spent performance to Developer No. 8 prepared in Example 8.

EXAMPLE 9

[Preparation of Toner No. 9]

The following components were kneaded and pulverized in an extruder, and the pulverized mixture was classified, whereby toner particles with a volume mean diameter of 6.5 μm were obtained:

| | Parts by Weight |
|---|---|
| Polyester resin prepared by copolymerization so as to include the repeat unit of formula (III-1) in Example 4 in an amount of 20 wt. % | 86 |
| Carbon black (Trademark "#44" made by Mitsubishi Chemical Industries, LTD.) | 10 |
| Second type quaternary-ammonium-base containing copolymer (Mw. 25,000) [the ratio of the repeat unit of formula (I-1):the repeat unit of formula (II-1):the repeat unit of formula (III-1) is 90.0:1.5:8.5] | 4 |

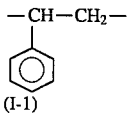

(I-1)

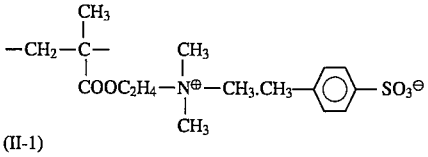

(II-1)

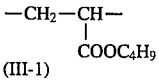

(III-1)

The thus obtained toner particles are referred to as Toner No. 9 of the present invention.

[preparation of Carrier]

| | | Parts by Weight |
|---|---|---|
| Core material: | Spherical particles of ferrite with an average particle diameter of 100 μm | 100 |
| Coating liquid: | Silicone resin solution (Trademark "SR2411" made Dow Corning Toray Silicone Co., Ltd. | 20 |

A mixture of the above components with the above formulation was mixed in a fluidized bed coating apparatus, whereby the surface of the ferrite particles was coated with the above coating liquid, and the coated liquid was dried and solidified, whereby a carrier for use in the present invention was obtained.

Developer No. 9 was prepared by mixing the above prepared Toner No. 9 and carrier with the concentration of the toner in the developer being 3 wt. %.

The charge quantity of this developer using the toner was 25 μC/g.

The above prepared Developer No. 9 was subjected to the same evaluation tests as in Example 1. The results are shown in Table 7.

Comparative Example 5

[Preparation of Comparative Toner No. 6]

The following components were kneaded and pulverized in an extruder, and the pulverized mixture was classified, whereby toner particles with a volume mean diameter of 6.5 μm were obtained:

| | Parts by Weight |
|---|---|
| Polyester resin | 99.5 |
| Carbon black (Trademark "#44" made by Mitsubishi Chemical Industries, LTD.) | 10 |
| Second type quaternary-ammonium-base containing copolymer (Mw. 25,000) [the ratio of the repeat unit of formula (I-1):the repeat unit of formula (II-1):the repeat unit of formula (III-1) is | 0.5 |

-continued

| | Parts by Weight |
|---|---|
| 89:10:1 | |

The thus obtained toner particles are referred to as Comparative Toner No. 5.

Comparative Developer No. 5 was prepared by mixing the above prepared Comparative Toner No. 5 and the carrier with the concentration of the toner in the developer being 3 wt. %.

The charge quantity of this developer using the above toner was 27 μC/g, which was not so much different from the charge quantity of the developer prepared in Example 9.

The above Comparative Developer No. 5 was subjected to the same evaluation tests as in Example 1. The results are shown in Table 7.

TABLE 7

| | Test Items | Number of Copies Made | | | | | |
|---|---|---|---|---|---|---|---|
| | | 0 | 20000 | 40000 | 60000 | 80000 | 100000 |
| Ex. 9 | Toner Deposition | 0.12 | 0.12 | 0.12 | 0.12 | 0.12 | 0.12 |
| | Toner Scattering | 0.12 | 0.12 | 0.12 | 0.12 | 0.12 | 0.12 |
| | Spent Amount | 0 | 0 | 0 | 0.01 | 0.01 | 0.02 |
| Comp. Ex. 5 | Toner Deposition | 0.12 | 0.12 | 0.13 | 0.14 | 0.15 | 0.18 |
| | Toner Scattering | 0.12 | 0.14 | 0.24 | 0.30 | 0.38 | 0.55 |
| | Spent Amount | 0 | 0.01 | 0.03 | 0.06 | 0.09 | 0.11 |

The results shown in the above Table 7 indicate that Developer No. 9 comprising Toner No. 9 prepared in Example 9 is superior to Comparative Developer No. 5 prepared in Comparative Example 5.

What is claimed is:

1. A positively-chargeable toner which comprises (a) a binder resin, (b) a coloring agent, and (c) a quaternary-ammonium-base containing copolymer with a weight-average molecular weight of 5,000 to 25,000, comprising a repeat unit of formula (I) in an amount by weight of 98.0 to 99.5, and a repeat unit of formula (II) in an amount by weight of 2.0 to 0.5, when the total amount by weight of the repeat unit of formula (I) and the repeat unit of formula (II) is 100:

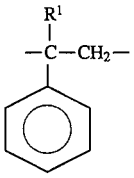

(I)

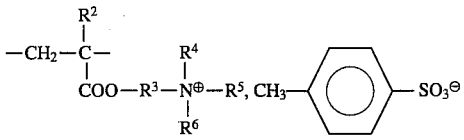

(II)

wherein $R^1$ is a hydrogen atom or a methyl group; $R^2$ is a hydrogen atom or a methyl group; $R^3$ is an alkylene group, and $R^4$, $R^5$ and $R^6$ are an alkyl group.

2. The positively-chargeable toner as claimed in claim 1, wherein said alkylene group represented by $R^3$ has 1 to 12 carbon atoms.

3. The positively-chargeable toner as claimed in claim 1, wherein said alkyl group represented by $R^4$, $R^5$, and $R^6$ has 1 to 12 carbon atoms.

4. The positively-chargeable toner as claimed in claim 1, wherein said binder resin contains 50 wt. % or more of polyester resin, and the softening point of the toner is 85° C. or less.

5. A positively-chargeable toner which comprises (a) a binder resin, (b) a coloring agent, and (c) a quaternary-ammonium-base containing copolymer with a weight-average molecular weight of 5,000 to 25,000, comprising a repeat unit of formula (I) in an amount by weight of 98.5 to 63.0, a repeat unit of formula (II) in an amount by weight of 2.0 to 0.5, and a repeat unit of formula (III) in an amount by weight of 35.0 to 1.0 when the total amount by weight of the repeat unit of formula (I), the repeat unit of formula (II), and the repeat unit of formula (III) is 100:

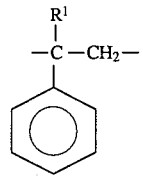

(I)

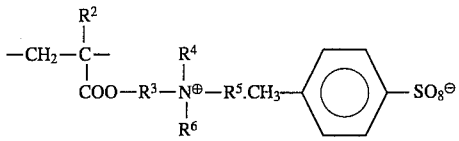

(II)

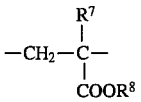

(III)

wherein $R^1$, $R^2$ and $R^7$ are independently a hydrogen atom or a methyl group; $R^3$ is an alkylene group, and $R^4$, $R^5$, $R^6$ and $R^8$ are an alkyl group, which may be the same or different.

6. The positively-chargeable toner as claimed in claim 5, wherein said alkylene group represented by $R^3$ has 1 to 12 carbon atoms.

7. The positively-chargeable toner as claimed in claim 5, wherein said alkyl group represented by $R^4$, $R^5$, $R^6$ and $R^8$ has 1 to 12 carbon atoms.

8. The positively-chargeable toner as claimed in claim 5, wherein said binder resin contains 50 wt. % or more of polyester resin and the softening point of said toner is 85° C. or less.

* * * * *